US008178015B2

(12) United States Patent
Harris et al.

(10) Patent No.: US 8,178,015 B2
(45) Date of Patent: May 15, 2012

(54) PROCESS AND DEVICE FOR MELT-SPINNING AND COOLING SYNTHETIC FILAMENTS

(75) Inventors: Wiley Scott Harris, Pompano Beach, FL (US); Fumin Lu, Tamarac, FL (US); Henning Rave, Achterwehr (DE); Holger Schöttler, Klein Rönnau (DE)

(73) Assignee: Oerlikon Textile GmbH & Co. KG, Remscheid (DE)

( * ) Notice: Subject to any disclaimer, the term of this patent is extended or adjusted under 35 U.S.C. 154(b) by 0 days.

(21) Appl. No.: 12/430,310

(22) Filed: Apr. 27, 2009

(65) Prior Publication Data

US 2009/0256278 A1 Oct. 15, 2009

Related U.S. Application Data

(63) Continuation of application No. PCT/EP2007/061709, filed on Oct. 30, 2007.

(30) Foreign Application Priority Data

Nov. 10, 2006 (DE) ..... 10 2006 052 970

(51) Int. Cl.
*D01D 5/092* (2006.01)
*D01D 5/16* (2006.01)

(52) U.S. Cl. ..... 264/103; 264/211.12; 264/555; 425/72.2; 425/378.2; 425/382.2

(58) Field of Classification Search ..... 425/72.2, 425/192, 378.2, 382.2; 264/211.14, 555, 264/103, 211.12
See application file for complete search history.

(56) References Cited

U.S. PATENT DOCUMENTS

| | | | | |
|---|---|---|---|---|
| 3,108,322 | A * | 10/1963 | Tate | 425/72.2 |
| 3,659,980 | A * | 5/1972 | Fernandez | 425/72.2 |
| 4,812,112 | A * | 3/1989 | Balk | 425/66 |
| 5,034,182 | A * | 7/1991 | Sze et al. | 264/555 |
| 5,433,591 | A * | 7/1995 | Zingsem et al. | 425/72.2 |
| 5,460,500 | A * | 10/1995 | Geus et al. | 425/66 |
| 5,766,646 | A * | 6/1998 | Geus et al. | 425/72.2 |
| 6,103,158 | A * | 8/2000 | Schafer et al. | 264/103 |
| 6,444,151 | B1 * | 9/2002 | Nguyen et al. | 264/101 |
| 6,692,687 | B2 * | 2/2004 | Chang et al. | 264/555 |
| 7,153,115 | B2 * | 12/2006 | Leon et al. | 425/72.2 |
| 7,322,811 | B2 * | 1/2008 | Schroter | 425/66 |
| 7,682,142 | B2 * | 3/2010 | Lennemann et al. | 425/66 |

(Continued)

FOREIGN PATENT DOCUMENTS

DE 1660642 A1 12/1970

(Continued)

*Primary Examiner* — Joseph Del Sole
*Assistant Examiner* — Nahida Sultana
(74) *Attorney, Agent, or Firm* — BainwoodHuang

(57) ABSTRACT

A process and a device involves melt-spinning and cooling synthetic filaments. Therein, a plurality of filaments is extruded from a polymer melt and, after the extrusion, is guided into a cooling shaft for cooling. Within the cooling shaft cool air is blown, via a blower wall, into the cooling shaft, where, for cooling, the filaments are guided along the blower wall and at a distance from it. In order to obtain cooling adapted to the particular filament titer, the blowing onto the filaments can be set by selecting one of several operating positions, where to change the operating position of the blower wall it is moved in the direction towards the filaments or in the direction away from the filaments.

15 Claims, 5 Drawing Sheets

U.S. PATENT DOCUMENTS

| | | | | |
|---|---|---|---|---|
| 7,687,012 | B2 * | 3/2010 | Daniels et al. | 264/555 |
| 2001/0033037 | A1 * | 10/2001 | Nitschke et al. | 264/40.3 |
| 2003/0141611 | A1 * | 7/2003 | Giese | 264/40.1 |
| 2003/0161904 | A1 * | 8/2003 | Geus et al. | 425/72.2 |
| 2005/0008728 | A1 * | 1/2005 | Wilkie et al. | 425/72.2 |
| 2005/0066689 | A1 * | 3/2005 | Eis et al. | 65/381 |
| 2005/0087288 | A1 * | 4/2005 | Haynes et al. | 156/167 |
| 2005/0140067 | A1 * | 6/2005 | Berrigan et al. | 264/518 |
| 2006/0040008 | A1 * | 2/2006 | Geus et al. | 425/72.2 |
| 2006/0145385 | A1 * | 7/2006 | Fujii et al. | 264/130 |
| 2006/0202383 | A1 * | 9/2006 | Stundl et al. | 264/211.14 |
| 2006/0273483 | A1 * | 12/2006 | Vakili et al. | 264/103 |
| 2007/0057414 | A1 * | 3/2007 | Hartge | 264/555 |
| 2007/0138686 | A1 * | 6/2007 | Reutter et al. | 264/103 |
| 2007/0284776 | A1 * | 12/2007 | Hisada et al. | 264/211.22 |
| 2009/0214813 | A1 * | 8/2009 | Van Den Berg et al. | 428/96 |
| 2010/0062672 | A1 * | 3/2010 | Fare' | 442/409 |
| 2010/0099321 | A1 * | 4/2010 | Fare' | 442/401 |
| 2011/0020628 | A1 * | 1/2011 | Fukudome et al. | 428/221 |
| 2011/0121480 | A1 * | 5/2011 | Weigend et al. | 264/103 |
| 2011/0250812 | A1 * | 10/2011 | Pourdeyhimi et al. | 442/337 |
| 2011/0298148 | A1 * | 12/2011 | Nakano et al. | 264/103 |

FOREIGN PATENT DOCUMENTS

| | | | |
|---|---|---|---|
| DE | 10053731 | A1 | 5/2001 |
| WO | 01/53573 | A1 | 7/2001 |
| WO | WO2006/000429 | A1 * | 1/2006 |

* cited by examiner

PROCESS AND DEVICE FOR MELT-SPINNING AND COOLING SYNTHETIC FILAMENTS

CROSS REFERENCE TO RELATED APPLICATIONS

This Patent Application is a Continuation of International Patent Application No. PCT/EP2007/061709 filed on Oct. 30, 2007, entitled, "PROCESS AND DEVICE FOR MELT-SPINNING AND COOLING SYNTHETIC FILAMENTS", the contents and teachings of which are hereby incorporated by reference in their entirety.

TECHNICAL FIELD

Embodiments of the invention relate to a process for melt-spinning and cooling synthetic filaments as well as a device for carrying out the process.

BACKGROUND

In the production of synthetic yarns, fibers, or fleeces it is generally known that a plurality of fine strand-like filaments is first extruded from a polymer melt. For this, the polymer melt is pressed through fine capillary holes of a spinning device, preferably a spinneret, so that the polymer melt exits from the capillary holes in fine, strand-like filaments. After the extrusion of the filaments it is necessary to cool them to solidify the polymer melt. For this, the filaments are guided through a cooling shaft where, at least from one inner side of the cooling shaft, cool air is blown, via a blower wall, into the cooling shaft. The blower wall, which, for example, can be formed by a wire mesh or several sieves, is disposed at a distance from the filament bundles so that the cool air exiting from the blower wall flows into the cooling shaft essentially in the direction transverse to the filaments and leads to the cooling of the filaments. A process of this type and a device of this type follow, for example, from DE 100 53 731 A1.

SUMMARY

In a conventional process and device the blower wall is provided with cool air via the blower chamber. In so doing, the intensity of the cool air entering into the cooling shaft is determined essentially by the composition of the blower wall as well as the pressure prevailing in the blower chamber. The cooling of the filaments is essentially dependent on the speed of flow with which the cool air strikes the filaments. To that extent the composition and the position of the blower wall is decisive for the cooling of the filaments which is achieved.

The conventional process and device thus carry out an optimized cooling of the filaments for a certain range of filament titers. If filaments with finer or coarser titers are extruded, an adaptation of the cooling can only be achieved via an increase or a reduction of the amount of cool air.

Embodiments of the present invention are directed to a process for the melt-spinning and cooling of generic synthetic filaments as well as a device for carrying out the process in such a manner that as great a flexibility as possible in the cooling of the freshly extruded filaments with different filament titers is ensured.

The process and the device are provided in such a manner that the cool air feed into the cooling shaft is flexible and can be changed.

Embodiments of the invention have the particular advantage that after the melt-spinning of the synthetic filaments a cooling of the filament strands adapted to the characteristics of the filaments, e. g. with regard to filament titer, is possible. In this connection, the setting of the blowing onto the filaments is advantageously done by selecting a predetermined operating position of the blower wall. For this, the blower wall can be guided into several operating positions, where, to change the operating position, the blower wall is moved in the direction towards the filaments or in the direction away from the filaments. With this the gaps formed between the blower wall and the filaments can be changed so that, in particular, the flow relationships between the cool air and the filaments can be set. Thus, for example, the filaments with a relatively coarse filament titer, the blower wall can be guided next to the filaments and at a short distance there from so that an intensive flow of the cool air for cooling the filaments can be used. In the case that filaments with finer filament titer are produced, the blower wall can be guided into an operating position which has an enlarged gap relative to the filaments. Thus, with the same amount of air a reduced flow speed of the cool air striking the filaments can be achieved and a less intensive cooling of the fine filament titer is made possible. Thus, filaments with coarse filament titers as well as filaments with fine filament titers can be cooled optimally while maintaining cooling sections of the same length.

The process advantageously allows the operating position of the blower wall to be changed by a pushing movement in the direction transverse to the filaments in order to be able to implement a change of the blowing acting on the filaments over the entire cooling section. Thus, a change in the gap between the blower wall and the filaments occurs uniformly over the entire run of the filaments.

To produce different cooling effects on the filaments within the cooling shaft, in one embodiment, the operating position of the blower wall can be changed by a tilting movement in the direction transverse to the filaments. In this manner, for example, a non-uniform gap between the blower wall and the filaments can be set. Thus, for example, it is a known practice, after the filaments have passed through the cooling section and formed a yarn, to combine the filaments to form a bundle so that, after the extrusion, the filaments are guided together to a convergence point. By corresponding inclination of the blower wall, a setting adapted to the filament run can thus be made where the setting makes the gap uniform over the converging run of the filaments. It is also possible to select the inclination of the blower wall in one operating position in such a manner that, in particular in the upper area of the cooling shaft, a less intensive cooling takes place by setting corresponding enlargements between the blower wall and the filaments. However, in the lower area, where there is already a pre-solidification of the filaments, an intensive remaining cooling takes place.

In order to obtain, in the case of a plurality of simultaneously extruded filaments, as intensive and uniform a cooling of the filaments as possible for cooling the filaments, a second cool air stream is blown, through a second blower wall, into the cooling shaft. The blower walls lie opposite one another in the cooling shaft and the operating positions of the two blower walls are selected independently of one another.

In another embodiment, used for example for the production of fleeces, the operating positions of the two blower walls are selected to be symmetric to the plurality of filaments when the plurality of filaments is guided as a filament curtain. With this, a uniform cooling of the filaments can be set at each side of the filament curtain. To make the cooling more or less intense, the operating positions of the two blower walls can be changed in a symmetric manner.

In the cooling of the filaments guided in a filament curtain it has been found to be advantageous if the cool air is guided, together with the filaments, at an outlet end of the cooling shaft through an exhaust outlet with an exit cross section whose size can be changed. In this manner, the pressures prevailing in the cooling shaft can be adjusted in order to thus change the amount of air exiting from the blower wall.

To set different exit cross sections of the exhaust outlet, the exhaust outlet is preferably formed between two opposing damming flaps. To select the size of the exhaust outlet, the damming flaps are displaced by a pivoting movement in the direction transverse to the filaments. With this, there is an additional effect on the cooling condition of the filaments. Along with the blowing speed of the cool air striking the filaments, the amounts of air exiting from the blower walls overall can thus also be adjusted.

In another embodiment of the process, part of the cool air is sucked in at an inlet end of the cooling shaft through a suction orifice having a suction cross section whose size can be changed. The air is discharged through suction ducts on both sides of the filament curtain, which are particularly suitable for discharging the monomers arising during the extrusion of the polymer melt. In this embodiment, a back-flow acting just below the spinning device is achieved by the suction orifice and the exiting cool air, the back flow, in particular, picking up and discharging all the volatile components after the extrusion of the filaments.

To adjust the back-flow, the suction orifice, according to one embodiment, is determined and adjusted in its suction cross section by damming plates which are disposed on both sides and can be displaced.

The device for carrying out the process includes a movable blower wall which can be guided relative to the spinning device into several operating positions in the direction transverse to the filaments. The device is thus particularly flexible for spinning and cooling synthetic filaments for producing yarns, fibers, or fleeces. In so doing, depending on the end product desired, a blowing adapted individually to the filaments can be realized within the cooling shaft.

In order to achieve this flexibility, the blower wall can be held within the cooling shaft by at least one pushing member so that the operating positions of the blower wall can be changed by simple pushing movements in the direction transverse to the filaments.

It is, however, also possible to hold the blower wall by at least one pivot member so that the operating positions of the blower wall can be changed by a tilting movement in the direction transverse to the filaments.

For cooling a filament bundle which, after the solidification and stretching is laid to form a fleece, an extension of the device is useful. The extension includes a second blower wall provided at the opposite inner side of the cooling shaft, where both blower walls can be held in several operating positions relative to the spinning device.

In this manner, the blower walls are preferably disposed so as to be symmetric to the spinning device in the selected operating positions so that a uniform and intensive cooling of all the filaments of the filament bundle guided as a filament curtain is achieved.

To generate a counter pressure acting in the interior of the cooling shaft and affecting the amount of cool air exiting, particularly in a manner opposite to that of the blower wall, the device is preferably extended in such a manner that the cooling shaft includes at an outlet an exhaust outlet with an exit cross section whose size can be changed.

With the use of two opposing blower walls one exhaust outlet configuration, in which two opposing pivotable damming flaps are held which, depending on their position, realize a more or less open exhaust outlet on the outlet side of the cooling shaft, has proven itself here in particular.

Furthermore, the device can be advantageously combined with a suction device provided below the spinning device in order to be able to execute a so-called monomer extraction. For this, the cooling shaft includes at one inlet a suction orifice with a suction cross section whose size can be changed, and a suction duct formed between the cooling shaft and the spinning device on each side of the filaments.

The suction orifice on the inlet side of the cooling shaft is advantageously formed by two opposing displaceable damming plates which can be displaced by a pushing movement in the direction transverse to the filaments to select the size of the suction orifice.

In order to generate a cool air stream exiting uniformly at the blower wall the blower wall is advantageously connected to a blower chamber. In so doing, the displacement of the operating position of the blower wall is advantageously done with the blower chamber so that no relative movements between the blower chamber and the blower wall have to be executed.

The process and the device are suitable in particular for cooling, individually and in a flexible manner, filament strands freshly extruded from a polymer melt. In this connection, embodiments of the invention can be integrated into any spinning process independently of whether the filaments are guided to form a yarn, to form individual fiber strands or spinning cables, or to form a flat fabric, such as, for example, a fleece.

BRIEF DESCRIPTION OF THE DRAWINGS

In the following, embodiments of the invention will be explained in more detail with the aid of several examples of the device.

Represented are.

DETAILED DESCRIPTION

Figure 1:
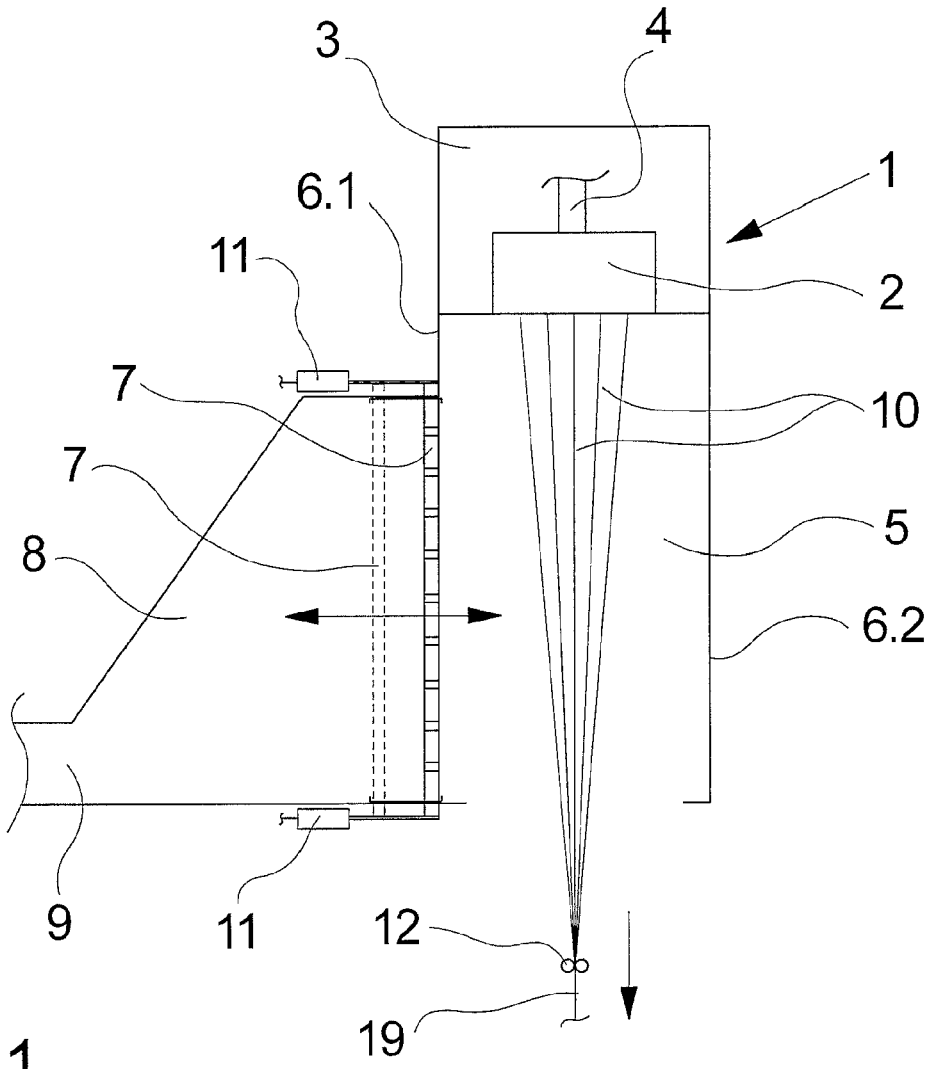
FIG. 1 in schematic form a cross-sectional view of an example of the device according to the invention for carrying out the process according to an embodiment of the invention.
Figure 2:
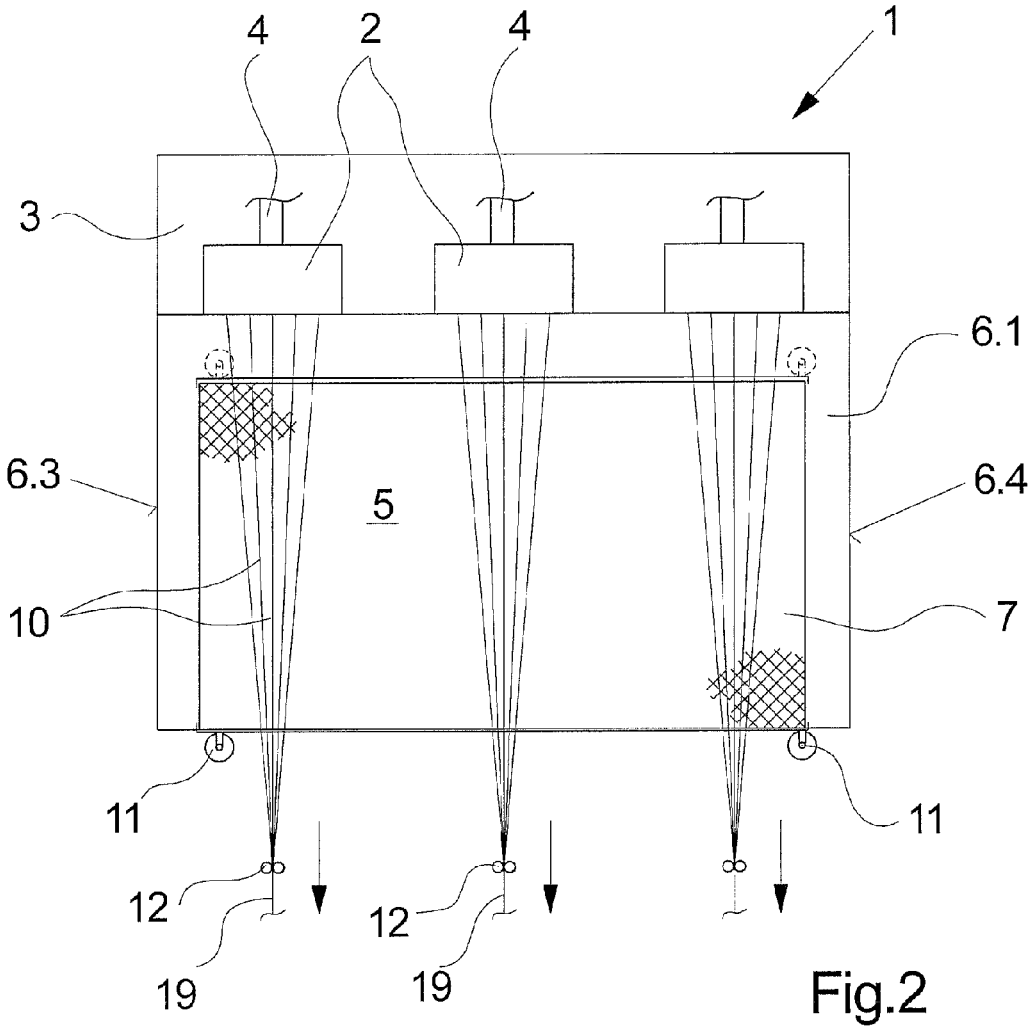
FIG. 2 in schematic form a longitudinal-sectional view of the example according to FIG. 1.

In FIG. 1 and FIG. 2 a first example embodiment of a device for carrying out a process is represented in schematic form. In FIG. 1, the example embodiment is shown in a cross-sectional view and in FIG. 2 in a longitudinal-sectional view. In so far as no express reference to one of the figures is made, the following description applies to both figures.

The example embodiment includes a spinning device 1 for extruding a plurality of filaments of a polymer melt. In FIG. 1 and FIG. 2 the spinning device (or means) 1 is only represented with the components important for extruding the filaments. Thus, the spinning device 1 for extruding a group of filaments includes a spinneret packet 2. The spinneret packet 2 is connected, via a melt line 4, to a spinning pump not represented here. The spinneret packet 2 is held in a heated spinning bar 3.

As follows from FIG. 2, several spinneret packets 2 are held next to one another in the spinning bar 3 so that several groups of filaments 10 are extruded next to one another at the same time.

The example embodiment according to FIG. 1 and FIG. 2 shows a cooling shaft 5 below the spinning device 1. The cooling shaft 5 extends in the running direction of the filaments 10 and forms a cooling section in which the freshly extruded filaments are cooled and thus solidified. The cooling shaft 5 is separated from the environment by the cooling shaft walls 6.1 and 6.2, as well as the walls 6.3 and 6.4 disposed at the end faces. The cooling shaft walls 6.1, 6.2, 6.3, and 6.4 form a square casing of the cooling shaft 5. On an inner side of the cooling shaft 5 a recess to receive a blower wall 7 is provided in the cooling shaft wall 6.1. The blower wall 7 extends here essentially over the entire length of the cooling shaft 5, as well as the width of the cooling shaft 5. The blower wall 7 is formed so as to be permeable to air, and is preferably formed by one or more sieve plates or wire meshes.

A blower chamber 8 is associated with the blower wall 7, the blower chamber being connected, via a cool air intake 9, to a cool air source not represented here. The blower wall 7 is held in such a manner that it can move, on the inner side of the cooling shaft 5, by pushing member (or means) 11. Through the pushing member 11 the blower wall 7 can be held to the side on the cooling shaft 5 in several operating positions. Here, to change the operating position of the blower wall 7, it is moved by the pushing member 11 in the vertical direction so that the blower wall moves in the direction towards the filaments in order to reduce a blowing gap between the blower wall 7 and the filaments 10. To increase the blowing gap between the blower wall 7 and the filaments 10, the blower wall 7 can be moved in the direction away from the filaments 10. A position of this type is represented as a dashed line in FIG. 1. The direction of movement of the blower wall 7 is marked by an arrow in FIG. 1.

The operating positions of the blower wall 7 can be set individually, where preferably a total displacement path is predetermined by the pushing member 11. In this embodiment, the pushing members 11 are formed, by way of example, by several piston-cylinder units, each of which are connected, via connecting links, to the blower wall 7.

On the outlet side of the cooling shaft 5 several yarn guides 12 are provided, preferably centered with respect to the spinneret packet 2, in order to combine the filaments 10 of a spinneret packet 2 into a yarn 19.

The example embodiment represented in FIG. 1 and FIG. 2 is suitable, in particular, for spinning and cooling filaments to produce synthetic yarns. In devices of this type, it is customary that the spinneret packets 2 used in the spinning bar 3 are held in such a manner that they can be replaced so that, depending on the yarn type, the nozzle plate held on the underside of the spinneret packets 2 can be selected, with regard the number of capillary holes and in the diameter of the capillary, and replaced. In order to be able to carry out cooling adapted to each of the freshly extruded filaments, the blowing onto the filaments is set by an accordingly selected operating position of the blower wall 7. Thus, yarns with coarse as well as fine filament titers can be produced without changing the length of the cooling section.

The example embodiment according to FIGS. 1 and 2 is also suitable, in particular, for combining the filament bundles to form a fiber strand which, after the melt-spinning and cooling, is fed to additional processing to form a spinning cable. Thus, the spinning cable can be treated further, continuously or discontinuously, by intermediate positioning in a can in a fiber path to form staple fibers.

Figure 3:
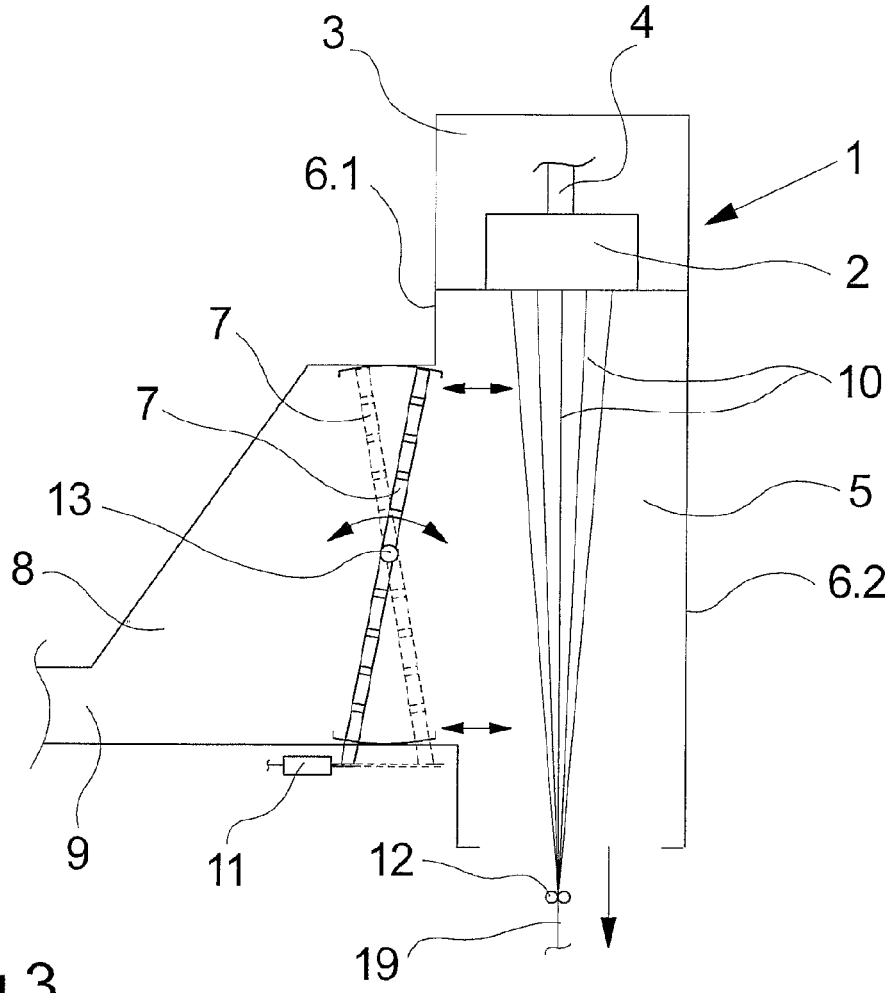
FIG. 3 in schematic form a cross-sectional view of an additional example of the device.

In FIG. 3 an additional example embodiment of the device for carrying out the process is shown in a cross-sectional view. The example embodiment is essentially identical to the example embodiment according to FIGS. 1 and 2, so that at this point only the differences will be explained and otherwise reference will be made to the aforementioned description.

In the device represented in FIG. 3 the spinning member 1 and the cooling shaft 5 are identical to the previously shown example embodiment according to FIGS. 1 and 2.

On an inner side of the cooling shaft 5 the blower wall 7 is held in the cooling shaft wall 6.1. The blower wall 7 is held, via a pivoting member 13, in such a manner that the operating positions of the blower wall 7 can be set by a tilting movement in the direction transverse to the filaments. As pivoting member 13 in this example embodiment is a pivot axle provided in the central area of the blower wall 7 as well as a piston-cylinder unit engaging at one end of the blower wall 7. Here, the blower wall 7 can preferably be moved so that its upper end moves away from the filaments 10 so that an increased blowing gap between the blower wall and the filaments 10 is set. Consequently, the tilting movement of the blower wall 7 leads to the lower end of the blower wall 7 moving towards the filaments so that a reduced blowing gap results. With this, a cool air flow, adapted to the filaments 10 combined by the yarn guide 12 to form a bundle, can be generated in the cooling shaft 5. Here, for example, a constant blowing distance to the outer filaments could be achieved over the entire length of the cooling section.

The example embodiment represented in FIG. 3 is, however, also particularly suitable for generating, within the cooling section, different cooling zones for cooling the filaments. Thus, for example, by increasing the blowing gap in the upper area of the cooling section a lesser pre-cooling of the filaments can be set. In contradistinction to this, in the lower area the blowing speed of the cool air during the flow onto the filaments increases due to a smaller blowing gap between the filaments.

Figure 4:
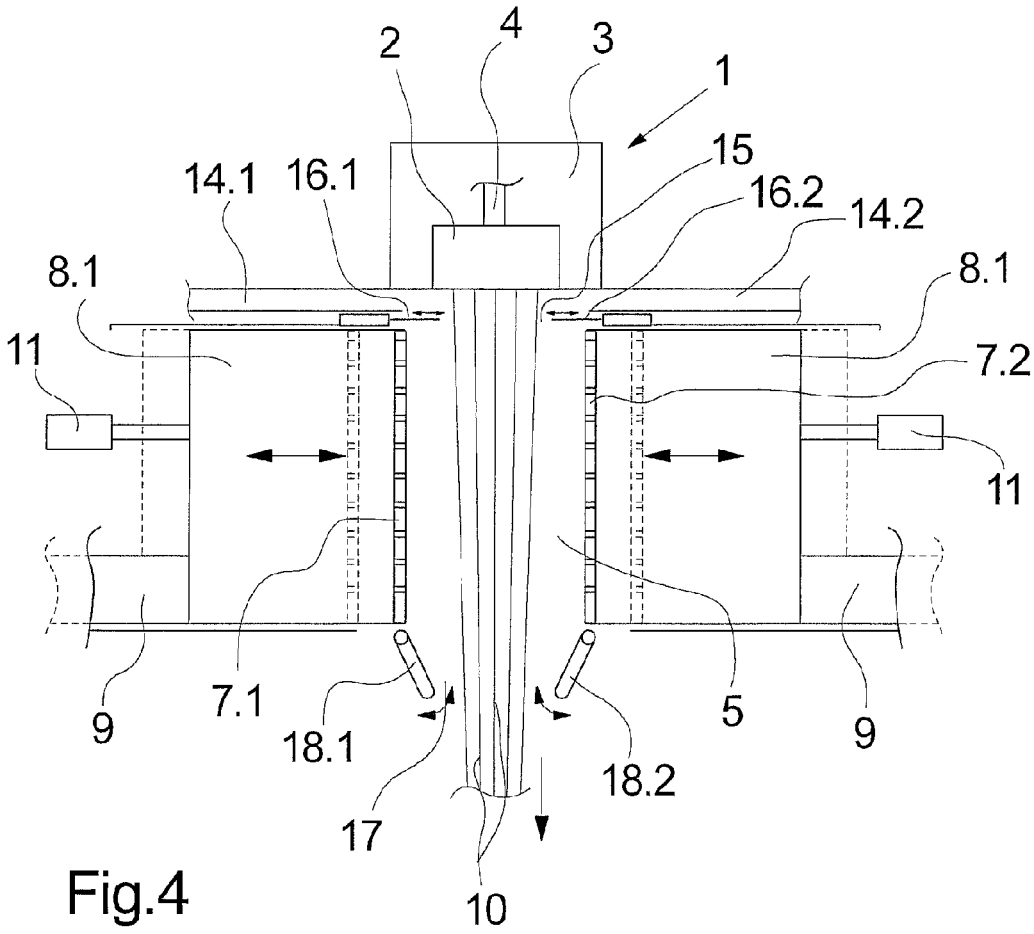
FIG. 4 in schematic form a cross-sectional view of an additional example of the device.
Figure 5:
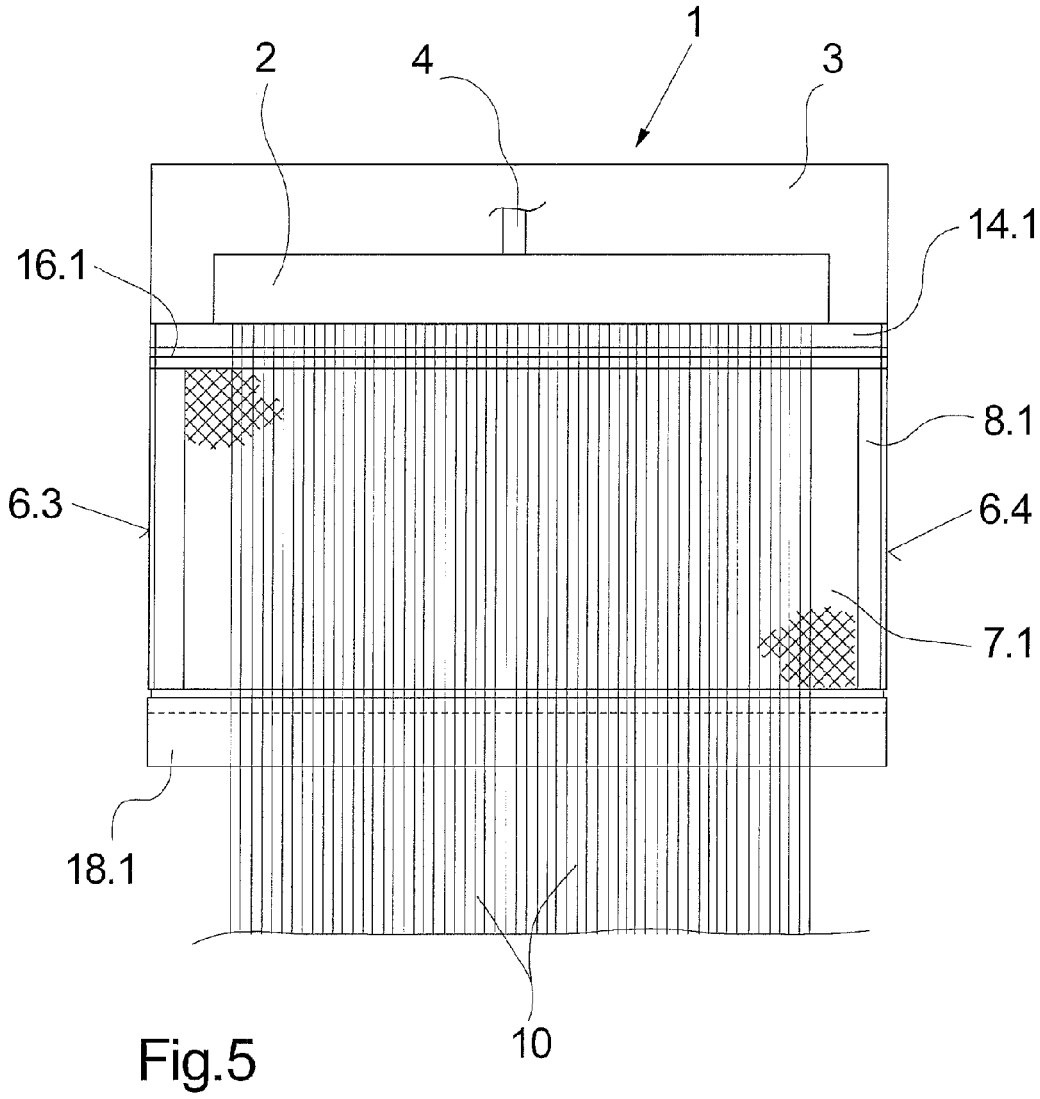
FIG. 5 in schematic form a longitudinal-sectional view of the example from FIG. 4.

In FIG. 4 and FIG. 5 an additional example embodiment of a device for carrying out the process is shown in schematic form in several views. Here, in FIG. 4, the device is represented in a cross-sectional view and in FIG. 5 in a longitudinal-sectional view. In so far as no express reference to one of the figures is made, the following description applies to both figures.

In the example embodiment represented in FIGS. 4 and 5 an elongated spinneret packet 2 is held in a spinning bar 3 as the spinning device 1. The spinneret packet 2 is connected, at least via a melt feed line 4, to a spinning pump not represented here. Spinning device 1 of this type is preferably used for the melt-spinning of a filament bundle which, after the melt-spinning and cooling, is laid onto a moving laying device, e.g. a belt, to form a fleece. For this, the filaments 10 exit as a filament curtain from the spinneret packet 2.

Below the spinning device 1 a cooling shaft 5 is formed. The cooling shaft 5 includes at each of its inner longitudinal sides two opposing blower walls 7.1 and 7.2. The blower walls 7.1 and 7.2 are each connected to a blower chamber 8.1 and 8.2. Each of the blower chambers 8.1 and 8.2 includes a cool air intake 9, through which cool air is conducted into the blower chambers 8.1 and 8.2. The blower chambers 8.1 and 8.2 are each held in such a manner that they can move relative to the spinning device 1 so that a cooling shaft width K between the blower walls 7.1 and 7.2 is set. The operating positions of the blower walls 7.1 and 7.2 are set by vertical displacement of the blower chambers 8.1 and 8.2. Here, an arrangement of the blower walls 7.1 and 7.2 which is symmetric to the spinning device 1 is preferably selected so that at each side of the filaments 10 an equal blowing gap between the blower walls 7.1 and 7.2 and the filaments 10 arises. For the displacement of each of the blower chambers 8.1 and 8.2 pushing members 11 are provided which, in the present example embodiment are formed by piston-cylinder units which engage on the blower chambers 8.1 and 8.2.

On the inlet side of the cooling shaft 5 a suction orifice 15 is formed. The suction orifice 15 formed between two damming plates 16.1 and 16.2 formed in such manner that they can be displaced. By displacing the damming plates 16.1 and 16.2 the width of the suction orifice 15, and thus the suction cross section, can be determined.

Between the underside of the spinning bar 3 and the damming plates 16.1 and 16.2, a suction duct 14.1 and 14.2 is formed on the respective sides of the filaments 10. Each of the suction ducts 14.1 and 14.2 is connected to a suction device (not represented here). The suction ducts 14.1 and 14.2 are connected, via the suction orifice 15, to the cooling shaft 5.

At an outlet of the cooling shaft 5 an exhaust outlet 17 with an exit cross section whose size can be changed is provided. For this, the exhaust outlet 17 is formed by two damming flaps 18.1 and 18.2 disposed at both sides of the filaments 10. The damming flaps 18.1 and 18.2 are each held, via a pivot axle, directly below the blower walls 7.1 and 7.2. To adjust the exhaust outlet 17 the damming flaps 18.1 and 18.2 are each displaced by a pivoting movement in the direction transverse to the filaments 10 so that the width of the exhaust outlet 17, and thus the exit cross section of the exhaust outlet 17, is changed.

As follows from the representation in FIG. 5, the blower walls 7.1 and 7.2, as well as damming plates 16.1 and 16.2 forming the suction orifice 15, and also the damming flaps 18.1 and 18.2 forming the exhaust outlet 17, extend over the entire width of the spinneret packet 2. At its end-face sides the cooling shaft 5 is preferably closed by the cooling shaft walls 6.3 and 6.4.

In the example embodiment represented in FIGS. 4 and 5 the filaments 10 are extruded from a polymer melt through the spinneret packet 2 to form a filament curtain. The filament curtain, which is drawn off from the spinning device 1 via a drawing member in the form of a drawing nozzle, enters, for cooling, into the cooling shaft and runs through the cooling shaft 5. Within the cooling shaft 5, via each of the blower walls 7.1 and 7.2, a cool air stream is generated at each side of the filaments 10 and blown into the cooling shaft 5. In so doing, the cooling shaft width K is pre-set as a function of a selected blowing gap between the filaments and the blower walls 7.1 and 7.2. Here, the setting is preferably made symmetrically in order to obtain a uniform cooling of all the filaments. In principle, however, there is also the possibility of selecting asymmetric operating positions of the blower walls 7.1 and 7.2 in order to obtain, for example, certain effects in the cooling of the filaments.

In addition to the foregoing, the operating positions of the blower walls 7.1 and 7.2 are set by displacing the blower chambers 8.1 and 8.2 in the vertical direction transverse to the filaments in such a manner that blowing adapted to the filaments is achieved.

In the upper area of the cooling shaft 5, a part of the cool air is discharged through the suction ducts 14.1 and 14.2, via the suction orifice 15, in the direction opposite to the running direction of the filaments. Here, the volatile components arising during extrusion of the polymer melts are advantageously rinsed away via the cool air and subsequently discharged via the suction ducts 14.1 and 14.2.

The remaining cool air, together with the filaments 10, exits the cooling shaft 5 via the exhaust outlet 17. The exhaust outlet 17, depending on the pivot position of the damming flaps 18.1 and 18.2, can be set in such a manner that, for example, in the interior of the cooling shaft 5 a counter pressure can be built up. The counter pressure, acting in a manner opposite to that of the blower chambers 8.1 and 8.2, leads to reducing the amount of air blown through the blower walls 7.1 and 7.2. Thus, the counter pressure within the cooling shaft 5, and thus the amount of air flowing into the cooling shaft 5, can be changed via the exit cross sections of the exhaust outlet 17.

The example embodiment of the device and represented in FIGS. 4 and 5 is thus particularly suitable for spinning and discharging melt-spun filaments for the production of flat fabrics. This example embodiment is preferably used in the so-called spun bond processes. The members provided to form the suction orifice 15 and to form the exhaust outlet 17 are coupled, preferably in such a manner that they are fixed, to the blower chambers 8.1 and 8.2 so that a base setting of the suction orifice 15 and the exhaust outlet 17 is given by the respective operating positions of the blower walls 7.1 and 7.2. Only for fine adjustment are the damming plates 16.1 and 16.2 and damming flaps 18.1 and 18.2 guided by additional pushing and pivoting means.

The example embodiments of the device and represented in FIGS. 1 to 5 are example in their design and composition of the components. In principle, combinations of the individual example embodiments can be used for constructing devices of this type. Thus, for example, the example embodiment according to FIG. 4 can be embodied with blower walls which are held in such a manner that they can be moved. Likewise, the example embodiment according to FIGS. 1 or 3 can each be embodied by blower chambers which are held in such a manner that they can be moved and with a blower wall connected in such a manner that it is fixed. To that extent embodiments of the invention extend to melt-spinning and cooling devices of the type in which freshly spun synthetic filaments are cooled with a cool air stream directed so as to be transverse thereto, and in which the device used to introduce the cool air into the cooling shaft are preferably a blower wall whose operating position can be changed. With this, a high degree of flexibility in the production of melt-spun filaments is achieved, which previously was limited when using only replaceable spinning means. With the use of replaceable spinneret packets, the device is to that extent most highly flexible for being able to produce filaments with fine titers or coarse titers.

To control the air flow or the air temperature or both it is also possible, that the blowing walls may consist of single or multiple zones, each with individual control means for air flow and/or temperature. Such example embodiment is preferably used for cooling filaments within a large range of titers, where in individual cooling conditions could be set up.

While various embodiments of the invention have been particularly shown and described, it will be understood by those skilled in the art that various changes in form and details may be made therein without departing from the spirit and scope of the invention as defined by the appended claims.

List of Reference Numbers

1 Spinning device
2 Spinneret packet
3 Spinning bar
4 Melt feed line
5 Cooling shaft
6.1, 6.2, 6.3, 6.4 Cooling shaft wall
7, 7.1, 7.2 Blower wall

8, 8.1, 8.2 Blower chamber
9 Cool air intake
10 Filaments
11 Pushing member
12 Yarn guides
13 Pivot axle
14.1, 14.2 Suction duct
15 Suction orifice
16.1, 16.2 Damming plate
17 Exhaust outlet
18.1, 18.2 Damming flap
19 Yarns

What is claimed is:

1. A device for melt-spinning and cooling of freshly extruded synthetic filaments to solidify the filaments having at least one spinning device for extruding a plurality of the filaments, comprising:

a cooling shaft for solidification of the freshly extruded filaments disposed below the spinning device, the cooling shaft having at least on one inner side a first movable blower wall through which cool air is blown into the cooling shaft;

wherein during operation the filaments are guided along the blower wall and at a distance there from and wherein the movable blower wall is held, relative to the spinning device, in one of several operating positions in alternation, wherein to change the operating position the blower wall is moved in either a direction towards the filaments, or in a direction away from the filaments;

wherein the device further comprises a second movable blower wall positioned at an inner side of the cooling shaft opposite the first movable blower wall, wherein both the first and second movable blower walls are constructed and arranged to be held in several operating positions relative to the spinning device;

wherein the cooling shaft includes an exhaust outlet having an exit cross section constructed and arranged to change size; and wherein the exhaust outlet includes a pivotable damming flap disposed below each of the blower walls, wherein the damming flaps are constructed and arranged to be displaced by a pivoting movement in a direction transverse to the filaments in order to select the size of the exit cross section of the exhaust outlet.

2. The device according to claim 1, wherein the first movable blower wall is held by at least one pushing member constructed and arranged to change the operating positions of the first movable blower wall by a tilting movement in a direction transverse to the filaments.

3. The device according to claim 1, wherein the first movable blower wall is held by at least one pivot member constructed and arranged to change the operating positions of the first movable blower wall by a tilting movement in a direction transverse to the filaments.

4. The device according to claim 1, wherein the first and the second movable blower walls are each disposed so as to be symmetric to the spinning device in the selected operating positions.

5. The device according to claim 1, wherein the cooling shaft includes a suction orifice at an inlet to the cooling shaft, the suction orifice being constructed and arranged to change size.

6. The device according to claim 5, further comprising a suction duct disposed on each side of the filaments and between the cooling shaft and the spinning device.

7. The device according to claim 5, wherein the suction orifice includes a displaceable damming plate positioned below each of the blower walls, wherein the damming plates are constructed and arranged to be displaced by a pushing movement in a direction transverse to the filaments to select the size of the suction orifice.

8. The device according to claim 1, wherein the first and the second blower walls are each connected to a respective blower chamber, and wherein each blower chamber is constructed and arranged to move to adjust the operating position of the respective blower wall.

9. The device according to claim 1 wherein a set of yarn guides is constructed and arranged to combine the filaments into yarn; and wherein the first movable blower wall of the cooling shaft is disposed between each spinning device and the set of yarn guides to cool the filaments while the filaments are (i) in a freshly extruded state and (ii) in the process of solidifying, prior to combining the filaments into the yarn.

10. Melt-spinning and cooling apparatus, comprising:

a spinning device which provides filaments in a freshly extruded state;

a cooling shaft coupled to the spinning device, the cooling shaft being disposed below the spinning device and having a set of walls which defines a cooling section;

wherein the cooling shaft is constructed and arranged to apply cooling air, from an air source, to the cooling section to cool and solidify the filaments provided by the spinning device while the filaments pass, as individual filament strands, through the cooling section; and wherein at least one wall is (i) permeable to allow cooling air to pass therethrough and (ii) movable between different operating positions relative to the spinning device;

wherein the cooling section defined by the set of walls of the cooling shaft has a horizontal cooling section width and a vertical cooling section height;

wherein the set of walls of the cooling shaft includes a movable blower wall which is permeable to air to apply cooling air from the air source to the filaments as the filaments pass through the cooling section as individual filament strands; and wherein the movable blower wall extends substantially over the horizontal cooling section width and the vertical cooling section height of the cooling section and is movable between different operating positions relative to the spinning device to enable the apparatus to properly process different filament titers while maintaining the vertical cooling section height of the cooling section through which the filaments pass as individual filament strands when processing the different filament titers;

wherein the melt-spinning and cooling apparatus further comprises:

a set of position controllers coupled to the cooling shaft, the set of position controllers being constructed and arranged to selectively hold the movable blower wall in (i) a first position during a first period of operation to process a first filament titer, and (ii) a second position during a second period of operation to process a second filament titer.

11. Melt-spinning and cooling apparatus as in claim 10 wherein the set of position controllers includes multiple cylinder units which are constructed and arranged to hold the movable blower wall at a first angular displacement relative to the spinning device during the first period of operation, and a second angular displacement relative to the spinning device during the second period of operation.

12. Melt-spinning and cooling apparatus as in claim 10 wherein the spinning device is constructed and arranged to provide the filaments in the freshly extruded state as a filament curtain; and wherein the cooling shaft is constructed and arranged to apply air on both sides of the filament curtain as the filaments pass as individual filament strands through the cooling section.

13. Melt-spinning and cooling apparatus as in claim 10, further comprising:

a filament combining stage coupled to the cooling shaft, the filament combining stage being constructed and arranged to receive the filaments as individual filament strands from the cooling section and combine the individual filament strands.

14. Melt-spinning and cooling apparatus, comprising:

a spinning device which provides filaments in a freshly extruded state:

a cooling shaft coupled to the spinning device, the cooling shaft being disposed below the spinning device and having a set of walls which defines a cooling section;

wherein the cooling shaft is constructed and arranged to apply cooling air, from an air source, to the cooling section to cool and solidify the filaments provided by the spinning device while the filaments pass, as individual filament strands, through the cooling section; and wherein at least one wall is (i) permeable to allow cooling air to pass therethrough and (ii) movable between different operating positions relative to the spinning device;

wherein the cooling section defined by the set of walls of the cooling shaft has a horizontal cooling section width and a vertical cooling section height;

wherein the set of walls of the cooling shaft includes a first movable blower wall and a second movable blower wall which lies opposite the first movable blower wall, each movable blower wall being permeable to air to apply cooling air from the air source to the filaments as the filaments pass through the cooling section as individual filament strands; and wherein each movable blower wall extends substantially over the horizontal cooling section width and the vertical cooling section height of the cooling section and is movable between different operating positions relative to the spinning device to enable the apparatus to properly process different filament titers while maintaining the vertical cooling section height of the cooling section through which the filaments pass as individual filament strands when processing the different filament titers;

wherein the melt-spinning and cooling apparatus further comprises:

a set of position controllers coupled to the cooling shaft, the set of position controllers being constructed and arranged to selectively hold the first and second movable blower walls parallel to each other (i) at a first distance during a first period of operation to provide the cooling section with a first cooling section depth as measured perpendicularly from the first and second movable blower walls, and (ii) at a second distance during a second period of operation to provide the cooling section with a second cooling section depth as measured perpendicularly from the first and second movable blower walls.

15. Melt-spinning and cooling apparatus, comprising:

a spinning device which provides filaments in a freshly extruded state:

a cooling shaft coupled to the spinning device, the cooling shaft being disposed below the spinning device and having a set of walls which defines a cooling section;

wherein the cooling shaft is constructed and arranged to apply cooling air, from an air source, to the cooling section to cool and solidify the filaments provided by the spinning device while the filaments pass, as individual filament strands, through the cooling section; and wherein at least one wall is (i) permeable to allow cooling air to pass therethrough and (ii) movable between different operating positions relative to the spinning device;

wherein the cooling section defined by the set of walls of the cooling shaft has a horizontal cooling section width and a vertical cooling section height;

wherein the set of walls of the cooling shaft includes exactly one movable blower wall which is permeable to air to apply cooling air from the air source to the filaments as the filaments pass through the cooling section as individual filament strands; and wherein the movable blower wall extends substantially over the horizontal cooling section width and the vertical cooling section height of the cooling section and is movable between different operating positions relative to the spinning device to enable the apparatus to properly process different filament titers while maintaining the vertical cooling section height of the cooling section through which the filaments pass as individual filament strands when processing the different filament titers;

wherein the exactly one movable blower wall lies opposite to a non-movable wall of the cooling shaft, the non-movable wall being substantially vertical in orientation; and wherein the movable blower wall is constructed and arranged to reside in a non-vertical operating position to provide the cooling section with a non-symmetrical cross-section while the filaments pass as individual filament strands through the cooling section.

* * * * *